US006039035A

United States Patent [19]

McPherson

[11] Patent Number: 6,039,035

[45] Date of Patent: *Mar. 21, 2000

[54] ELASTICALLY MOUNTED COUNTERWEIGHT FOR A CAM OR PULLEY

[76] Inventor: Mathew A. McPherson, 19055 Incline Rd., Norwalk, Wis. 54648

[ * ] Notice: This patent is subject to a terminal disclaimer.

[21] Appl. No.: 09/266,184

[22] Filed: Mar. 10, 1999

[51] Int. Cl.[7] ..... F41B 5/10

[52] U.S. Cl. ..... 124/25.6; 124/900

[58] Field of Search ..... 124/25.6, 900

[56] References Cited

U.S. PATENT DOCUMENTS

D. 331,614 12/1992 Martin et al. ..... D22/107
4,401,097 8/1983 Simonds et al. ..... 124/25.6
4,438,753 3/1984 Simonds ..... 124/25.6
4,478,203 10/1984 Hayes ..... 124/25.6
4,512,326 4/1985 Jarrett ..... 124/25.6
4,993,399 2/1991 Chattin ..... 124/25.6
5,174,268 12/1992 Martin et al. ..... 124/25.6
5,809,982 9/1998 McPherson ..... 124/25.6

*Primary Examiner*—John A. Ricci
*Attorney, Agent, or Firm*—Vidas, Arrett & Steinkraus, P.A.

[57] ABSTRACT

A rotating member for use with a compound bow, including a body having a rotation point for journaling the body to a bow limb, the body including a damping device for absorbing vibrational energy as the rotating member vibrates against a bowstring when the rotating member returns to a rest position from a drawn position.

15 Claims, 3 Drawing Sheets

ELASTICALLY MOUNTED COUNTERWEIGHT FOR A CAM OR PULLEY

CROSS-REFERENCE TO RELATED APPLICATIONS

Not applicable.

STATEMENT REGARDING FEDERALLY SPONSORED RESEARCH

Not applicable.

BACKGROUND OF THE INVENTION

Applicant is the inventor of U.S. Pat. No. 5,809,982, which issued Sep. 22, 1998 and was entitled "Compound Bow With Counteracting Weight", the entire contents of which are hereby incorporated by reference.

When a cam returns to the rest position after the bow is shot, it vibrates or oscillates back and forth very quickly, along with the bowstring, with the vibration damping out over a short period of time. Applicant has discovered that by mounting the counterweight elastically or resiliently to the cam, the vibration is more quickly dampened out because the counterweight acts in opposition to the vibration, as well as providing the other benefits discussed in connection with U.S. Pat. No. 5,809,982.

BRIEF SUMMARY OF THE INVENTION

The inventive elastically mounted counterweight is comprised of a body having a rotation point for journaling the body to a bow limb. The body includes a damping device for absorbing vibrational energy as the rotating member vibrates against a bowstring when the rotating member returns to a rest position from a drawn position.

The rotating member may either be a cam or a pulley and may either be used on a single rotating member or both rotating members on the bow.

The damping device may be a counterweight which is either resiliently or elastically mounted to the body, such as carrying the counterweight in a rubber mounting ring.

The end of the extension arm may itself be elastically or resiliently mounted to the remainder of the extension arm to dampen vibration, either alone or in combination with the elastically mounted counterweight.

These and other more detailed and specific objectives and an understanding of the invention will become apparent from a consideration of the following Detailed Description of the Invention in view of the Drawings.

DETAILED DESCRIPTION OF THE INVENTION

Figure 1:
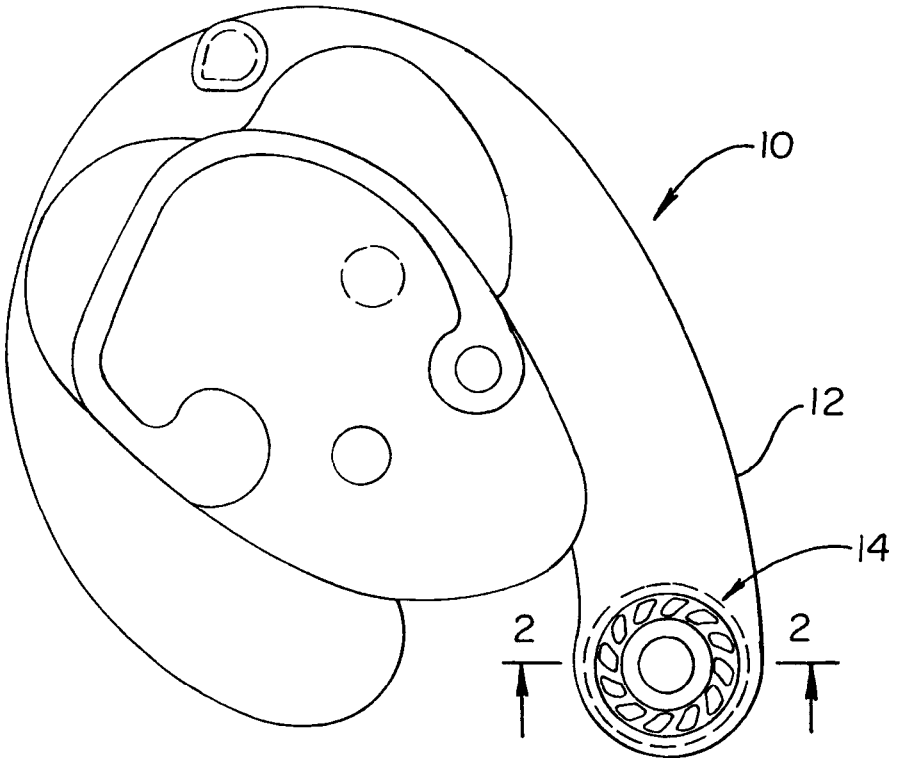
FIG. 1 is a top view of the inventive elastically mounted counterweight in a cam.

While this invention may be embodied in many different forms, there are shown in the drawings and described in detail herein a specific preferred embodiment of the invention. The present disclosure is an exemplification of the principles of the invention and is not intended to limit the invention to the particular embodiment illustrated.

Figure 2:
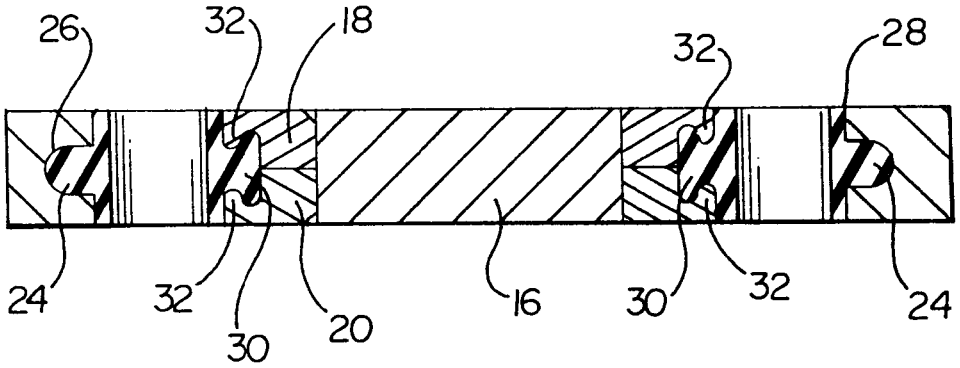
FIG. 2 is a cross sectional view of the rubber ring of the preferred embodiment.
Figure 3:
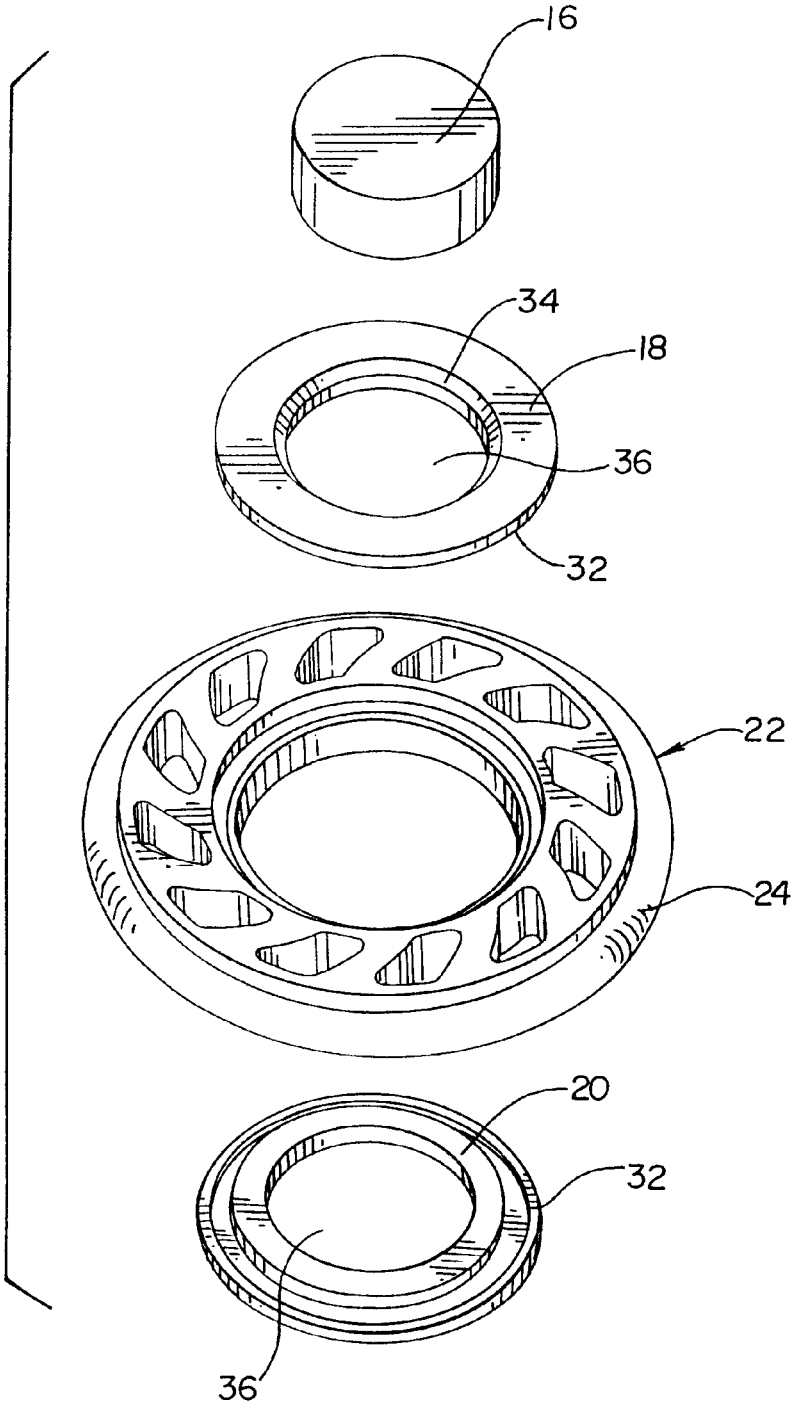
FIG. 3 is an exploded perspective view of the counterweight and the locking rings used to connect it to the rubber ring.

Referring now to FIGS. 1–3, a cam is shown generally at 10 in FIG. 1. The cam includes an extension arm 12 and an elastically or resiliently mounted counterweight, shown generally at 14. As seen best in FIG. 3, a weight 16 is press fit between a top and bottom locking rings, shown respectively at 18 and 20. A rubber ring, shown generally at 22 contains a lip 24 which is received by a slot or groove 26 in a mounting chamber 28 of the extension arm 12. The rubber ring 22 contains a double sided flange 30. The top and bottom locking rings 18 and 20 contain lips 32 which fit around flange 30 to lock the rings to rubber ring 22. This can be seen best in FIG. 2. Locking rings 18 and 20 are beveled at 34 and have openings 36 sized to friction fit with weight 16.

To assemble resiliently mounted counterweight 14, the lip 24 of the resilient rubber ring 22 is inserted into slot or groove 26 in the cam 10. Then the locking rings 18 and 20 are mounted around flange30 and the weight 16 is press fit into openings 36, which locks the weight 16 and locking rings 18 and 20 to the rubber ring 22. With the weight 16 installed as described the resiliency of rubber ring 22 is reduced locking the lip 24 of the rubber ring into slot or groove 26 in cam 10.

Ring 22 may be made of any elastic or resilient energy absorbing material, such as for example sorbothane, or rubber, or a thermoplastic or thermoset elastomer, although it is made of Dupont ALCYN® 2080BK, a thermoplastic elastomer, in the preferred embodiment. Weight 16 may be made of any material, but is made of tungsten carbide in the preferred embodiment. It is preferable that weight 16 be made of a material which is denser than the material of the cam, which is an aluminum alloy in the preferred embodiment. Locking rings 18 and 20 may be made of any suitable metal or alloy, but in the preferred embodiment are made of brass or an alloy of brass.

Figure 4:
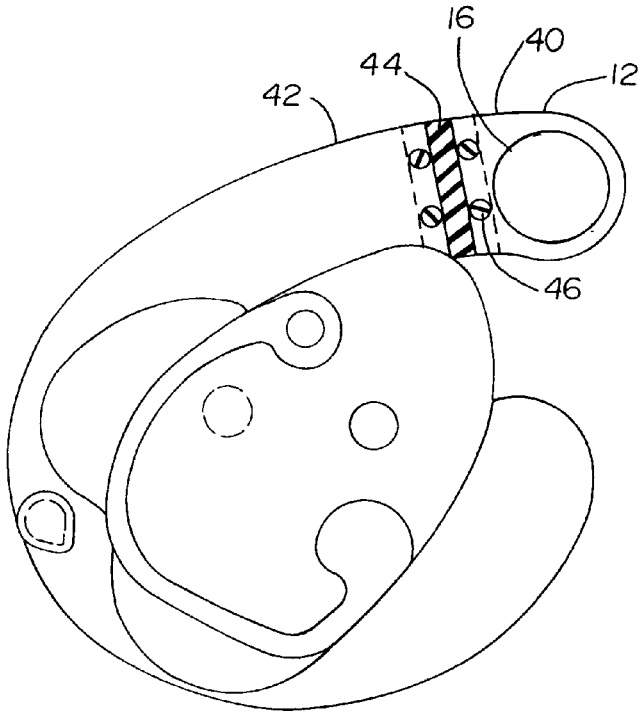
FIG. 4 is a top view of an alternate embodiment of the elastically mounted counterweight.

Referring now to FIG. 4, an alternate embodiment is shown in which cam 10 is shown with a counterweight 16 press fit into extension arm 12. Extension arm 12 is comprised of an end or tip portion 40, which is elastically attached to a base portion 42 by means of rubber connector 44. Rubber connector 44 has lips extending from each end which fit into a slot or groove in the ends of 40 and 42. Screws 46 are used to fasten 40, 42 and 44 together. It should be understood that counterweight 16 could itself be elastically mounted in extension arm 14 as shown in FIG. 1.

Figure 5:
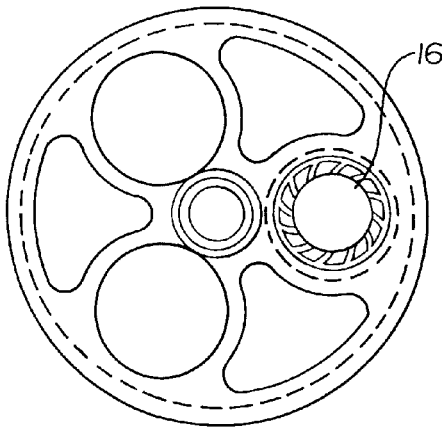
FIG. 5 is a top view of a pulley with a single counterweight elastically mounted.
Figure 6:
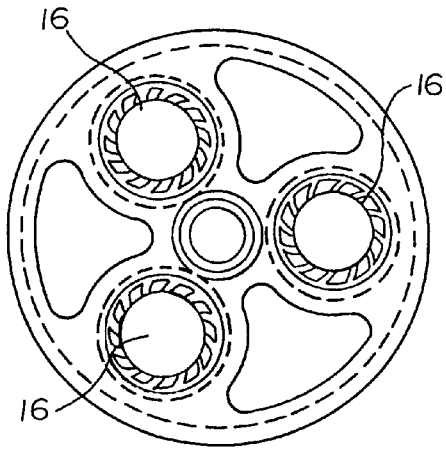
FIG. 6 is a top view of a pulley with three counterweights elastically mounted.

FIG. 5 shows a pulley in which a counterweight 16 is elastically mounted as shown in connection with FIGS. 1–3. FIG. 6 shows a pulley in which three counterweights 16 are elastically mounted as shown in connection with FIGS. 1–3. The counterweights of FIG. 6 are evenly spaced around the periphery of the pulley.

It will be understood that this disclosure, in many respects, is only illustrative. Changes may be made in details, particularly in matters of shape, size, material, means of attachment, and arrangement of parts without exceeding the scope of the invention. Accordingly, the scope of the invention is as defined in the language of the appended Claims.

What is claimed is:

1. A rotating member for use with a compound bow, comprising:

a body having a rotation point for journaling the body to a bow limb, the body including a damping device for absorbing vibrational energy as the rotating member vibrates against a bowstring when the rotating member returns to a rest position from a drawn position.

2. The rotating member of claim 1 wherein the damping device is comprised of a counterweight which is resiliently mounted to the body.

3. The rotating member of claim 2 wherein the counterweight is carried by an elastomeric mounting device, which is attached to the body, whereby as the rotating member vibrates against the bowstring, the elastomeric mounting device absorbs the kinetic energy of the counterweight and transfers it back to the counterweight such that the counterweight and elastomeric mounting device dampen the vibration of the rotating member against the bowstring.

4. The rotating member of claim 3 wherein the elastomeric mounting device is made of a thermoplastic elastomer.

5. The rotating member of claim 3 wherein the elastomeric mounting device is made of sorbothane.

6. The rotating member of claim 3 wherein the elastomeric mounting device is made of rubber.

7. The rotating member of claim 1 wherein the damping device is comprised of a counterweight which is elastically mounted to the body.

8. The rotating member of claim 1 wherein the rotating member is a cam.

9. The rotating member of claim 1 wherein the rotating member is a pulley.

10. A rotating member for use with a compound bow, comprising:

a body having a rotation point for journaling the body to a bow limb, the body including a weight which is resiliently mounted to the body.

11. The rotating member of claim 10 wherein the resiliently mounted weight moves relative to the body to absorb vibrational energy.

12. The rotating member of claim 10 wherein the weight may move relative to the body in response to forces acting on the body in opposition to the bodies state of rotation.

13. The rotating member of claim 10 wherein the rotating member is a cam.

14. The rotating member of claim 10 wherein the rotating member is a pulley.

15. The rotating member of claim 10 wherein the compound bow has a rest position and a drawn position, and wherein the rotating member vibrates against a bowstring as the bow returns to the rest position from the drawn position, the resiliently mounted weight absorbing vibrational energy to dampen the vibration.

* * * * *